US007331506B2

(12) United States Patent
Lai et al.

(10) Patent No.: US 7,331,506 B2
(45) Date of Patent: Feb. 19, 2008

(54) CARTON HANDLE

(75) Inventors: Kuo-Chuan Lai, Taipei County (TW); Yang Tsao Lung, Keelung (TW)

(73) Assignee: Hannspree, Inc., Taipei (TW)

( * ) Notice: Subject to any disclaimer, the term of this patent is extended or adjusted under 35 U.S.C. 154(b) by 0 days.

(21) Appl. No.: 11/443,086

(22) Filed: May 31, 2006

(65) Prior Publication Data

US 2007/0278281 A1 Dec. 6, 2007

(51) Int. Cl.
*B65D 5/46* (2006.01)

(52) U.S. Cl. ..... 229/117.24; 220/770; 229/125.39

(58) Field of Classification Search ..... 229/117.19, 229/117.23, 117.24, 125.39; 220/759, 767, 220/770

See application file for complete search history.

(56) References Cited

U.S. PATENT DOCUMENTS 3,221,977 A * 12/1965 Pollert ..... 229/117.23
3,276,663 A * 10/1966 Falconer ..... 229/117.24
3,875,843 A * 4/1975 Maeda et al. ..... 411/548
4,019,764 A * 4/1977 Okamura ..... 292/288
4,239,149 A * 12/1980 Kupersmit ..... 229/125.21
4,531,670 A * 7/1985 Kupersmit ..... 229/125.21
6,533,374 B2 * 3/2003 Hightower ..... 312/236
6,619,540 B1 * 9/2003 Bazany ..... 229/199
6,948,652 B2 * 9/2005 Andersson et al. .... 229/125.39
6,994,226 B2 * 2/2006 Shuert ..... 220/4.29

FOREIGN PATENT DOCUMENTS

TW 0852115 4/1996

* cited by examiner

*Primary Examiner*—Gary E Elkins
(74) *Attorney, Agent, or Firm*—Birch, Stewart, Kolasch & Birch, LLP

(57) ABSTRACT

A carton handle comprising a first base portion; a second base portion; a pair of retaining flanges which are extended outwardly on each side of the first and the second base portions; a connecting portion connecting the first and second base portions and a ring structure with a U-shape joined on top of the second base portion. First and second base portions are molded to have a generally rectangular shape and dimensions of an aperture in a carton wall such that, upon insertion in an aperture, the first and second base portions are movable to respective positions wherein the retaining flanges lie contiguous with one surface and the opposite surface of the carton wall.

16 Claims, 4 Drawing Sheets

CARTON HANDLE

BACKGROUND OF THE INVENTION

1. Field of the Invention

The present invention relates to a handle used for lifting a carton, and more particularly to a carton handle used for lifting a large industrial carton loaded with heavy household appliances or heavy goods.

2. Description of the Related Art

It is well known that cartons are frequently damaged through incorrect lifting. Cartons are usually made from low-strength cardboard, when a carton loaded with heavy goods is lifted at the location of an aperture or edge of the carton, this localized force can cause crushing or tearing of the carton wall. In addition, apertures are made from thin sheet of cardboard cutout therefore the rough edges on the side of apertures can cut or cause discomfort to the hands of the lifter. Referring to FIG. 1, Taiwanese patent publication No. 295084 discloses the conventional carton handle. The carton handle provides the protection for the carton, however, they are designed in a way that the handle needed to be insert in a particular direction and its very difficult to remove without damaging the carton wall.

SUMMARY OF THE INVENTION

The aforesaid conventional carton handle does not fully take into account user's requirements and also does not consider the design of the handle, therefore they are not the optimal design. This invention aims to provide an improvement in the carton handle.

The object of this invention is to provide an inexpensive and easy install/remove carton handle which will facilitate the handling of a carton. This invention relates to a carton handle comprising a first base portion; a second base portion; a pair of retaining flanges which are extended outwardly on each side of the first and the second base portions; a connecting portion connecting the first and second base portions and a ring structure with a U-shape joined on top of the second base portion. First and second base portions are molded to have a generally rectangular shape and dimensions of an aperture in a carton wall such that, upon insertion in an aperture, the first and second base portions are movable to respective positions wherein the retaining flanges lie contiguous with one surface and the opposite surface of the carton wall.

More specifically, the invention further comprises the first base portion, the second base portion, the pair of retaining flanges, the connecting portion and the ring structure as whole a monolithic molding of polymeric material, and said ring structure comprises a pair clips locking to the first base portion.

Further scope of applicability of the invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DETAILED DESCRIPTION OF THE INVENTION

Figure 1:
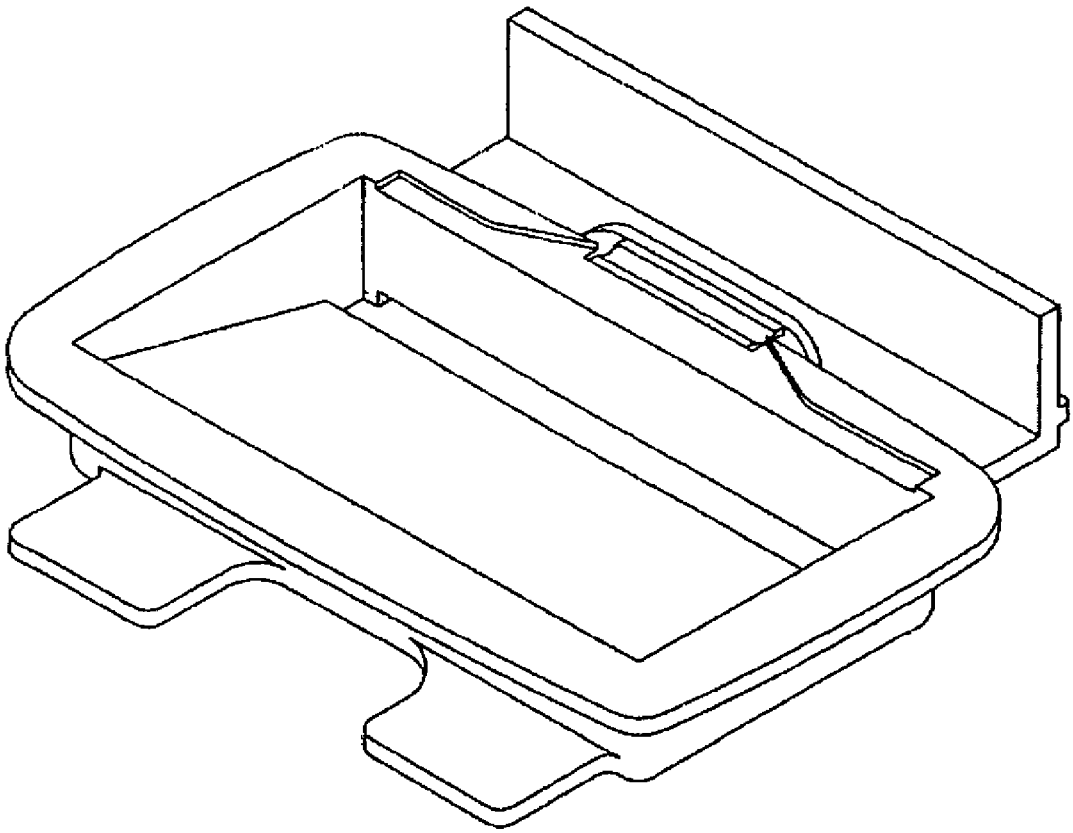
FIG 1. Prior Art
FIG. 1 is a perspective view of the conventional handle.
Figure 2:
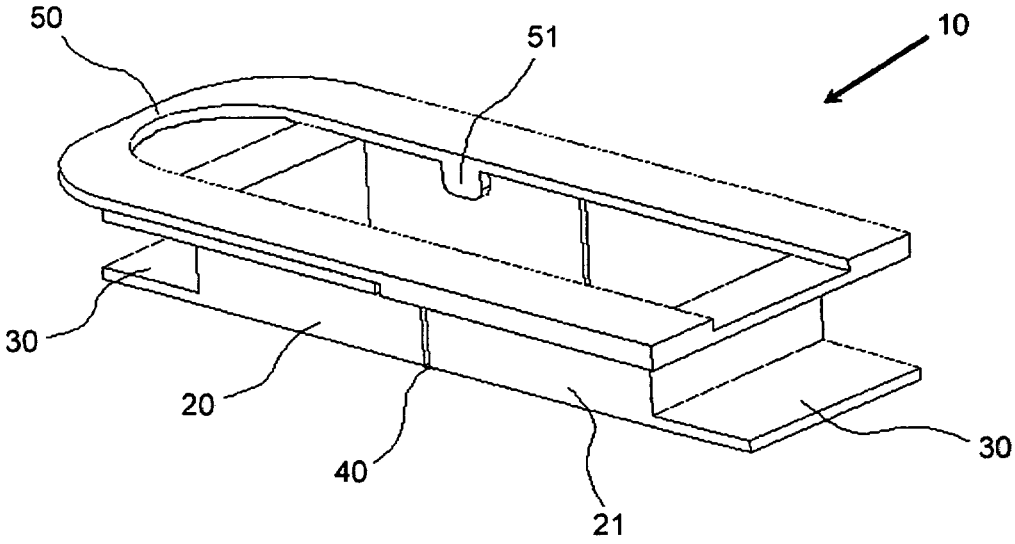
FIG. 2 is a perspective view of the present invention.

Referring to FIG. 2, a carton handle 10 is used to facilitate assembly to the carton, including a first base portion 20, a second base portion 21, a pair of retaining flanges 30, a connecting portion 40, and a ring structure 50.

Figure 3:
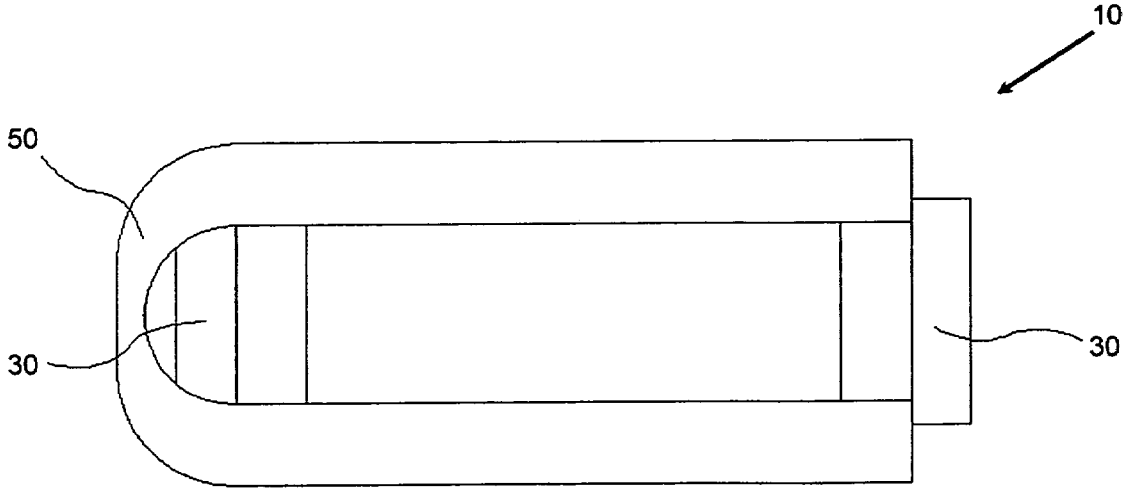
FIG. 3 is a top view of the present invention.
Figure 4:
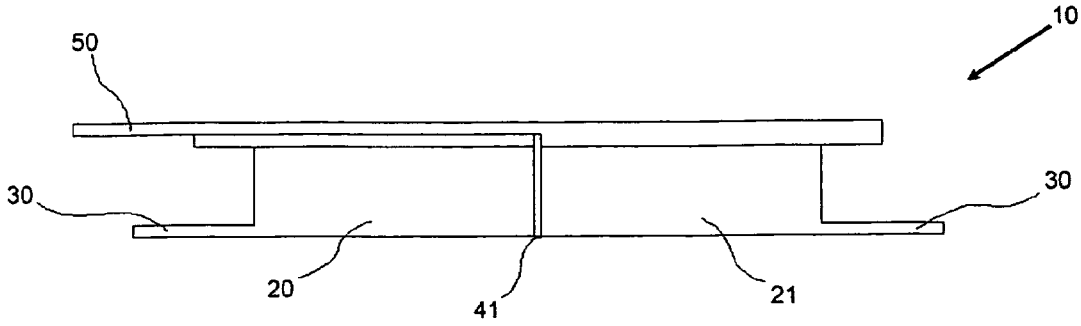
FIG. 4 is a side view of the present invention.
Figure 5:
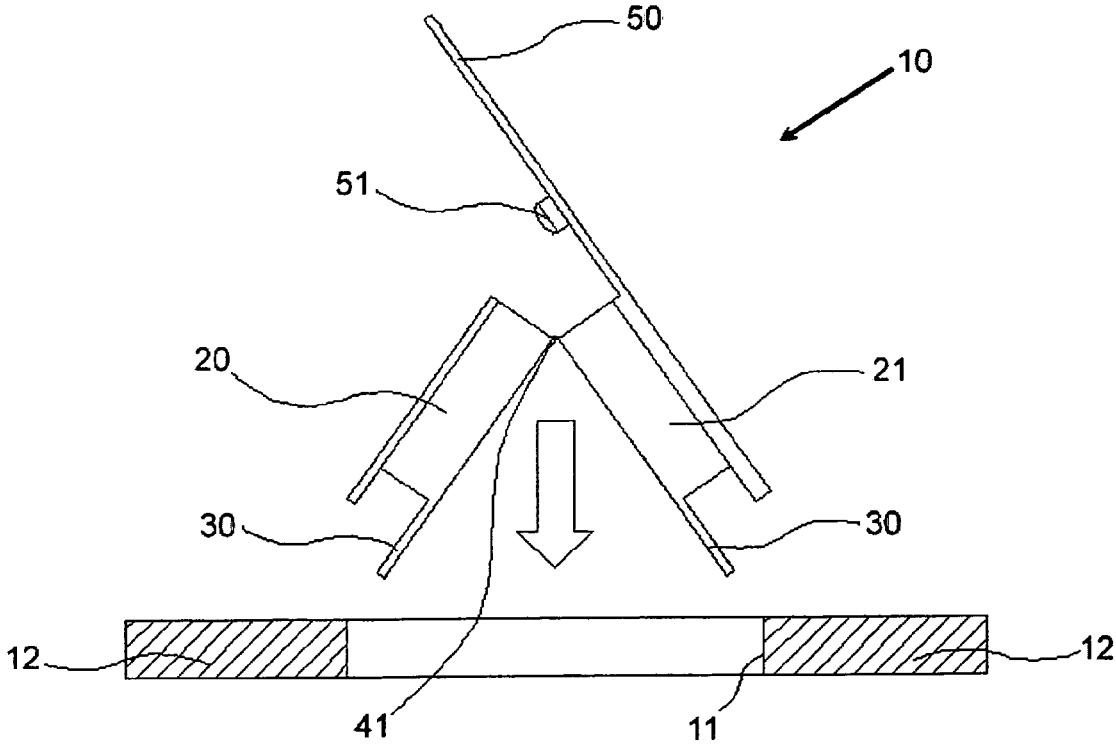
FIG. 5 is a side view of the present invention illustrating the first stage of insertion of the handle into an aperture in the carton wall.

The first base portion 20 and the second base portion 21 are molded to have a general rectangular shape to fit the dimensions of an aperture 11 of a carton wall 12, the retaining flanges 30 are extended outwardly from bottom of the first base portion 20 and the second base portion 21 as shown in FIG. 4. The whole carton handle 10 can be molded with polymeric material used is of the type wherein a flexible membrane can withstand fatigue, for example polypropylene or a composition of polyethylene and polypropylene. Therefore, in this case, the respective connecting portion 40 comprises two hinge webs 41 are hinged between the first base portion 20 and the second base portion 21 to provide a movable joint. The ring structure 50 joined on top of the second base portion 21 to form a U-shape as shown in FIG. 3. The ring structure 50 further comprises a pair of clips 51 as shown in FIG. 5 and FIG. 6.

Figure 6:
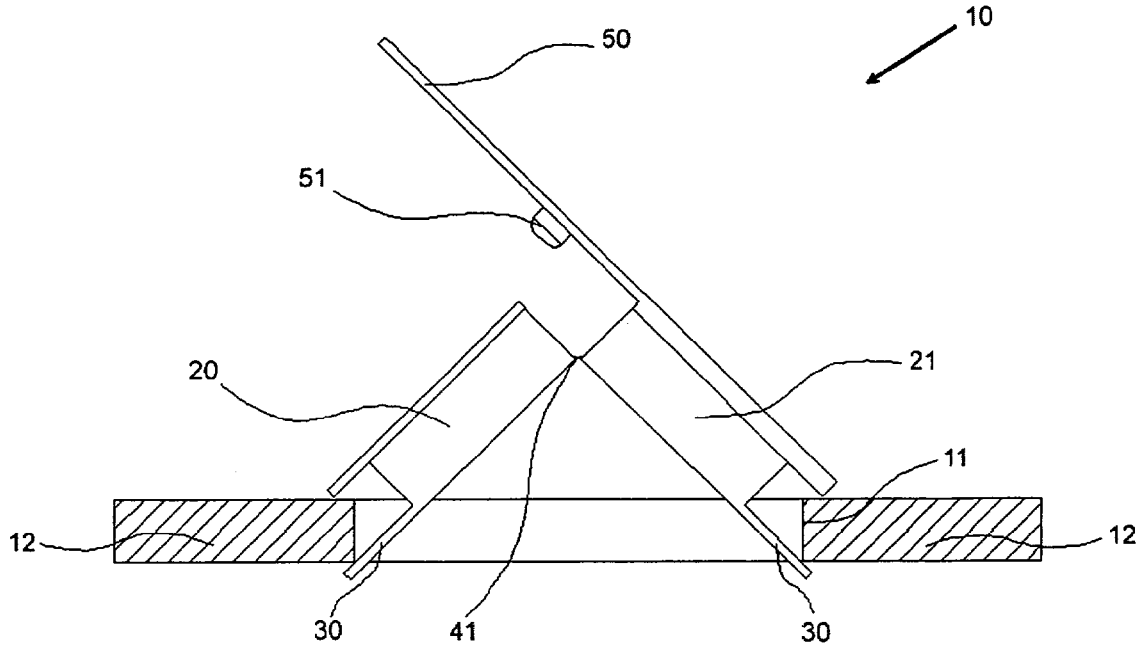
FIG. 6 is a side view of the present invention illustrating the second stage of insertion of the handle into an aperture in the carton wall.
Figure 7:
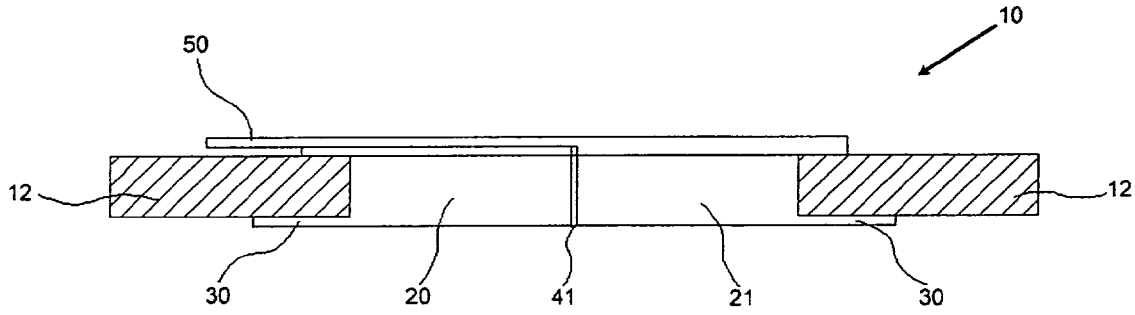
FIG. 7 is a side view of the present invention illustrating the handle fully inserted into an aperture in the carton wall with the clips means lock in place.

Referring to FIG. 6, when it is required to insert the carton handle 10 in the aperture 11 of the carton wall 12, the first base portion 20 and the second base portion 21 are folded in half and positioned into the aperture 11 so that the retaining flanges 30 engages the surfaces of the carton wall. When in this position, shown in FIG. 6, a force is applied to push down on the ring structure 50, the first base portion 20 and the second base portion 21 move to respective positions wherein the retaining flanges 30 lie contiguous with one surface and the opposite surface of the carton wall. The pair of clips 51 are locking to the first base portion 20 and securing the carton handle 10 in the aperture 11 of the carton wall 12 as shown in FIG. 7.

The carton handle 10 can be simply removed by pulling on the ring structure 50, the pulling force unlocks the pair of clips 51. Then fold back the first base portion 20 and the second base portion 21 in half and remove the carton handle 10 without damaging the aperture 11 of the carton wall 12. Moreover, the removed carton handle 10 can be use on other cartons or for future uses.

Various modifications in structure and/or function may be to the disclosed embodiments by one skilled in the art without departing from the scope of the invention as defined by the claims.

The invention claimed is:

1. A carton handle, comprising:

a first base portion and a second base portion;

a pair of retaining flanges which are extended outwardly from bottom of the first base portion and the second base portion;

a connecting portion connecting the first base portion and the second base portion to make the first base portion and the second base portion foldable; and a ring structure joined on top of the second base portion; wherein while the first base portion and the second base portion are arranged in a straight line, the ring structure is close against the first base portion.

2. A carton handle according to claim 1, wherein the first base portion, the second base portion, the retaining flange, the connecting portion and the ring structure are made of a polymer.

3. A carton handle according to claim 2, wherein the polymer is polypropylene.

4. A carton handle according to claim 2, wherein the polymer is a composition of polyethylene and polypropylene.

5. A carton handle according to claim 1, wherein the first base portion and the second base portion are formed to have rectangle shape.

6. A carton handle according to claim 1, wherein the connecting portion comprises a pair of hinge webs joining the first base portion and the second base portion.

7. A carton handle according to claim 1, wherein the ring structure comprises at least a clip, locking to the first base portion.

8. A carton handle according to claim 1, wherein the ring structure defines a hole for a hand to hold.

9. A carton handle according to claim 8, wherein the ring structure has a top surface, and the connecting portion connecting the first base portion and the second base portion to make the first base portion and the second base portion foldable along an imaginary folding axis, the imaginary folding axis being parallel to the top surface.

10. A carton handle inserted in a hole of a container wall, comprising:

a first base portion and a second base portion;

a pair of retaining flanges which are extended outwardly from bottom of the first base portion and the second base portion;

a connecting portion connecting the first base portion and the second base portion to make the first base portion and the second base portion foldable; and a holding means with a ring structure around the hole; wherein the ring structure joins the second base portion and while the first base portion and the second base portion are arranged in a straight line, the ring structure is close against the first base portion.

11. A carton handle according to claim 10, wherein the first base portion, the second base portion, the retaining flange, the connecting portion and the ring structure are made of a polymer.

12. A carton handle according to claim 11, wherein the polymer is polypropylene.

13. A carton handle according to claim 11, wherein the polymer is a composition of polyethylene and polypropylene.

14. A carton handle according to claim 10, wherein the first base portion and the second base portion are formed to have rectangle shape.

15. A carton handle according to claim 10, wherein the connecting portion comprises a pair of hinge webs joining the first base portion and the second base portion.

16. A carton handle according to claim 10, wherein the ring structure comprises at least a clip, locking to the first base portion.

* * * * *